US006415854B1

(12) United States Patent
Falkenö et al.

(10) Patent No.: US 6,415,854 B1
(45) Date of Patent: Jul. 9, 2002

(54) HEAT EXCHANGER UNIT AND USE

(75) Inventors: Anders Falkenö; Per Sandberg, both of Västerås (SE)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/385,749

(22) Filed: Aug. 30, 1999

(30) Foreign Application Priority Data

Sep. 9, 1998 (FI) ..... 981927

(51) Int. Cl.[7] ..... F28D 1/02
(52) U.S. Cl. ..... 165/152; 165/171; 165/182
(58) Field of Search ..... 165/152, 153, 165/110, 182, 171, 172, 183

(56) References Cited

U.S. PATENT DOCUMENTS

| | | | | | |
|---|---|---|---|---|---|
| 333,119 | A | * | 12/1885 | Ephraim | 165/172 |
| 3,809,155 | A | * | 5/1974 | Anthony et al. | 165/133 |
| 4,694,898 | A | * | 9/1987 | Clausen | 165/172 |
| 4,763,725 | A | * | 8/1988 | Longsworth et al. | 165/147 |
| 4,771,825 | A | * | 9/1988 | Chen et al. | 165/172 |
| 4,787,443 | A | * | 11/1988 | Fukatsu et al. | 165/165 |
| 5,082,051 | A | * | 1/1992 | Ando | 165/110 |
| 5,184,672 | A | * | 2/1993 | Aoki | 165/109.1 |
| 5,329,988 | A | * | 7/1994 | Juger | 165/153 |
| 5,671,806 | A | * | 9/1997 | Schmalzried | 165/81 |
| 5,799,725 | A | * | 9/1998 | Bradley, Jr. et al. | 165/182 |
| RE37,040 | E | * | 2/2001 | Hughes et al. | 165/176 |

FOREIGN PATENT DOCUMENTS

| | | |
|---|---|---|
| CH | 438 645 A | 12/1967 |
| DE | 2012441 | 9/1970 |
| FR | 2079269 | 11/1971 |
| GB | 1312521 | 4/1973 |
| GB | 1324132 | 7/1973 |

* cited by examiner

*Primary Examiner*—Henry Bennett
*Assistant Examiner*—Terrell McKinnon

(57) ABSTRACT

The invention relates to a heat exchanger unit to be used in a gas-fired water heater in which heater a heat exchanger unit contains tubes with fins. According to the invention the heat exchanger unit contains flat oval tubes (1,21,31) having a fin (3,22,32) at least on one flat part (4,24,33). The flat oval tubes (1,21,31) as well as the fins (3,22,32) are made of copper, copper-based alloy, aluminium or aluminium-based alloy.

14 Claims, 1 Drawing Sheet

HEAT EXCHANGER UNIT AND USE

Figure 1:
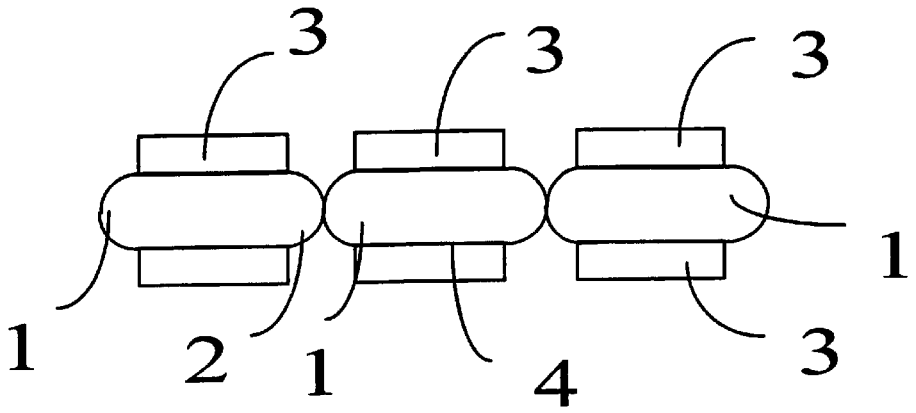

The invention relates to a heat exchanger unit to be used in a gas-fired water heater so that the total heat exchange of the heater has been improved without risk of condensation.

The GB patent application 2,016,135 describes a heat exchanger which is useful in a gas-fired water heater. This heat exchanger comprises a corrosion-resistant water-carrying pipe made of copper with heat-transfer fins soldered thereto. The pipe has a copper-bronze coating uniformly distributed around the external periphery of the pipe particularly where the fins are soldered thereto, the fins being made of titanium-stabilized or niobium-stabilized chrome steel sheet. The pipe openings in the fins are preferably provided with collars which encircle the pipe and by which the fins are hard-soldered to the pipe.

The EP patent 545,954 relates to a gas-fired water heater which has a row of water tubes mounted over the outlet duct of the combustion gases. The water tubes are mounted in fins each of which has a row of holes which are spaced to correspond to the spacing of the tubes which are connected at each end to the water chambers. The assembly of tubes and fins is supported on a bracket which has an upper vertical part with projecting tags which engage slots in the fin which is the second from the end. A second bracket which is attached to the first fin supports additional parts of the heater.

In these referred publications the water pipes or tubes are provided with individual heat-transfer fins which are arranged parallel to one another so that gaps are formed between the fins for the passage of the combustion gases. The water pipes and tubes are circular in cross-section and the fins are formed as a ring around the circular pipe and tube surfaces. Because of the circular shapes in the pipes, tubes and fins they need space and the heat exchanger unit in the gas-fired water heater has to be manufactured quite large in order that the heat exchange between the heated gas and water will be such that water is heated in reasonable time when thinking the end user for heated water. Further, the gas-fired water heater is quite heavy because of the voluminous heat exchanger unit.

The object of the present invention is to eliminate some drawbacks of the prior art and to achieve a heat exchanger unit lighter in weight and smaller in shape to be used in a gas-fired water heater. The essential novel features of the invention are apparent from the appended claims.

In accordance with the invention the heat exchanger unit for a gas-fired water heater has at least one heater element which contains a number of flat oval tubes in one or several rows. At least on one of the flat parts of the tube there are arranged fins made of a corrugated strip which fins have a strong metallic bond with the tube. The metallic bond is made by a braze or a solder material. The flat oval tube as well as the fin are made of metal, preferably for instance of aluminium, aluminium-based alloy, copper or copper-based alloy so that the materials for both the flat oval tube and the fin are the same or so that the material of the flat oval tube is different from the material of the fin. Because both the tubes and the fins in the heat exchanger unit of the invention are non-circular in cross-section, the tubes where the water to be heated is circulated, are advantageously arranged close to each other so that the heat exchanger unit is smaller and lighter than the one in the prior art.

In a preferred embodiment of the invention the flat oval tube is provided with the fins on the both flat parts of the periphery but the curved parts of the periphery are without fins. The flat oval tubes with fins on the flat parts of the periphery are installed side by side so that the curved parts without fins of the flat oval tubes are placed close to each other. Thus when two or more flat oval tubes with fins on the flat parts of the periphery are installed in the same plane side by side, the fins on the flat parts of the flat oval tubes make a substantially uniform heat transfer surfaces on both sides of the flat oval tubes with the fins.

When using the flat oval tubes with fins on the flat parts of the periphery in the gas-fired water heater hot gas heated by a gas burner is conducted to pass the substantially uniform heat transfer surfaces on both side of the flat oval tubes. This hot gas will heat the fins on the surfaces of the flat oval tubes and further the tubes and finally the water circulated inside the tubes.

In another embodiment of the invention the flat oval tubes are arranged to each other so that only one flat part of the periphery in the oval tube is needed to provide with the fin made of a corrugated strip. In this embodiment the tubes with one fin are arranged to each other so that the fin of one tube has a contact with the flat part of the adjacent tube. Thus the fin is positioned between two oval flat tubes.

In a further embodiment of the invention the flat oval tubes having the fins on the both flat parts of the periphery in the oval tube are arranged to each other so that one fin in one tube has a contact with the fin of the adjacent tube. Thus in this embodiment between two oval tubes there are arranged two fins.

The heat transfer in the heat exchanger unit of the invention is better than in the prior art because the flat oval tube has a better inside heat transfer capacity than the round tube having the same internal area. Further, the flat oval tubes can be arranged closer to each other than the round tubes. This narrow distance between the flat oval tubes makes possible to use thinner fins than in the prior art, but simultaneously allows higher fin density. This higher fin density gives more heat transfer area, but still reduces the total weight of the heat exchanger unit owing to the thinner fins.

Because of the structure with the substantially uniform transfer surfaces in the exchanger unit of the invention the exhaust gas temperature distribution is substantially uniform which makes possible to improve the total heat exchange without risk of condensation.

Using the heat exchanger unit of the invention the circulation of the heated water is carried out in a smaller area than in the prior art because the tubes are close to each other based on the construction of the fins on the surfaces of the flat oval tubes. Further, because the substantially uniform heat transfer surfaces on both side of the flat oval tubes improve the total heat exchange, the heat exchanger unit in the gas-fired water heater itself is smaller and lighter than in the prior art. Thus the gas-fired water heater with the heat exchanger unit of the invention is easy to use in many places.

Because the hot gases fed in the heat exchanger unit of the invention can have a large temperature distribution, it is also possible to use different fin densities in the different areas of the heat exchanger unit.

Figure 2:
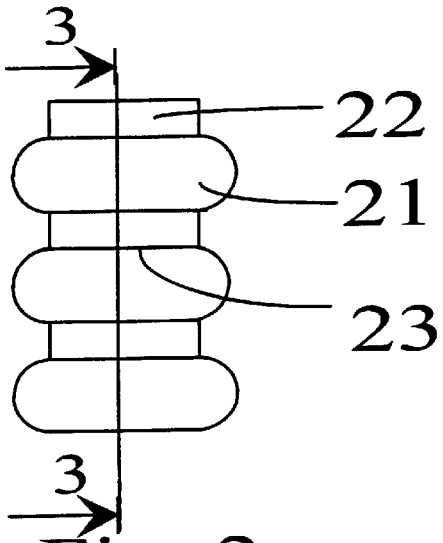
Figure 3:
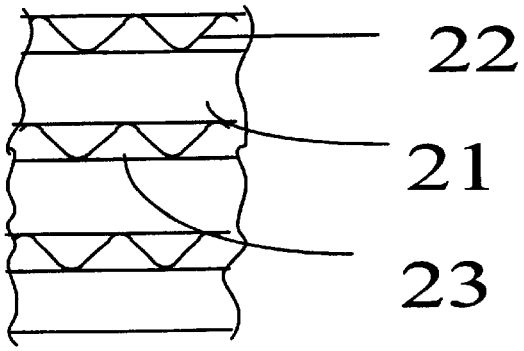
Figure 4:
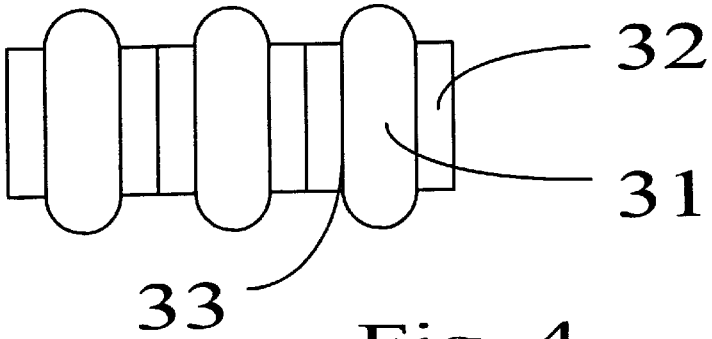

The invention is described in more detail with reference to the appended drawing, where FIG. 1 is a schematical and partial side-view illustration of a heater element in the preferred embodiment of the invention, FIG. 2 is a schematical and partial side-view illustration of a heater element in another embodiment of the invention, FIG. 3 is an illustration of the embodiment in FIG. 2 seen from the direction 3—3, and FIG. 4 is a schematical and partial side-view illustration of still another embodiment of the invention.

In FIG. 1 the flat oval tubes 1 are positioned to each other so that the curved parts 2 of the tubes are side by side so that the curved part 2 of the tube 1 has a contact with the curved part 2 of the adjacent tube 1. The fins 3 on both the flat parts 4 of the periphery of the flat oval tubes 1 form substantially uniform heat transfer surfaces on both sides of the tubes 1.

In FIGS. 2 and 3 the flat oval tubes 21 are provided with one fin 22 on one flat part 23 of the periphery of the tube 21. The tubes 21 are positioned side by side so that the fin 22 of one tube 21 has a contact with the flat part 23 of the adjacent tube 21.

In FIG. 4 the flat oval tubes 31 are provided with the fins 32 on both flat parts 33 of the periphery of the tube 31. The tubes 31 are positioned side by side so that one fin 32 of the tube 31 has a contact with the fin 32 of the adjacent tube 31.

What is claimed is:

1. A heat exchanger unit for use in a gas-fired water heater, wherein said heat exchanger unit contains flat oval tubes, said tubes having an exterior surface, said tubes also having a fin fixably attached to only one flat part of a tube wherein said flat oval tubes are positioned to each other so that a curved part of the tube has contact with the curved part of an adjacent tube.

2. The heat exchanger unit according to claim 1, wherein the fin is made of a corrugated strip.

3. The heat exchanger unit according to claim 1, wherein in the heat exchanger unit the flat oval tubes are positioned to each other so that the fin of one oval tube has a contact with the flat part of the adjacent tube.

4. The heat exchanger unit according to claim 1, wherein in the heat exchanger unit the flat oval tubes are positioned to each other so that one fin of the tube has a contact with the fin of the adjacent tube.

5. The heat exchanger unit according to claim 1, wherein the flat oval tube is made of copper.

6. The heat exchanger unit according to claim 1 wherein the flat oval tube is made of copper-based alloy.

7. The heat exchanger unit according to claim 1, wherein the flat oval tube is made of aluminum.

8. The heat exchanger unit according to claim 1 wherein the flat oval tube is made of aluminum-based alloy.

9. The heat exchanger unit according to claim 1, wherein the fin is made of copper.

10. The heat exchanger unit according to claim 1 wherein the fin is made of copper-based alloy.

11. The heat exchanger unit according to claim 1 wherein the fin is made of aluminum.

12. The heat exchanger unit according to claim 1 wherein the fin is made of aluminum-based alloy.

13. The heat exchanger unit according to claim 2, wherein in the heat exchanger unit the flat oval tubes are positioned to each other so that the fin of one oval tube has a contact with the flat part of the adjacent tube.

14. The heat exchanger unit according to claim 2, wherein in the heat exchanger unit the flat oval tubes are positioned to each other so that one fin of the tube has a contact with the fin of the adjacent tube.

* * * * *